US010497287B1

(12) United States Patent
Brush

(10) Patent No.: US 10,497,287 B1
(45) Date of Patent: Dec. 3, 2019

(54) CURVED IMAGE BEARING DOME COMPOSITE

(71) Applicant: James A Brush, Galesville, WI (US)

(72) Inventor: James A Brush, Galesville, WI (US)

( * ) Notice: Subject to any disclaimer, the term of this patent is extended or adjusted under 35 U.S.C. 154(b) by 822 days.

(21) Appl. No.: 14/756,922

(22) Filed: Oct. 31, 2015

Related U.S. Application Data

(60) Provisional application No. 62/122,868, filed on Nov. 1, 2014.

(51) Int. Cl.
*G09F 3/02* (2006.01)
*B41F 15/08* (2006.01)

(52) U.S. Cl.
CPC ..... *G09F 3/02* (2013.01); *B41F 15/0895* (2013.01); *G09F 2003/026* (2013.01); *G09F 2003/0208* (2013.01); *G09F 2003/0264* (2013.01)

(58) Field of Classification Search
CPC ..... G09F 3/02; G09F 2003/0208; G09F 2003/026; G09F 2003/0264; B41F 15/0895
See application file for complete search history.

(56) References Cited

U.S. PATENT DOCUMENTS

2004/0168755 A1* 9/2004 Parker ..... B44C 1/16 156/63
2013/0008589 A1* 1/2013 Kreutz ..... B31D 1/021 156/185

FOREIGN PATENT DOCUMENTS

FR 2882966 * 9/2006 ..... B42D 15/00

* cited by examiner

*Primary Examiner* — Robert S Walters, Jr.
(74) *Attorney, Agent, or Firm* — BRRLaw LLC; Bryan R. Rosiejka

(57) ABSTRACT

The invention provides thermoset image bearing domed composites which when bent to mately label or decal onto the curvature of a consumer good will characteristically retain its optical clarity without any visible component separation or stress fracturing. The domed composite suitably includes UV curable ink coatings which are securely and pliable bonded to the thermoset coating of a metal substrate and a cured thermoset capping dome.

10 Claims, 13 Drawing Sheets

CURVED IMAGE BEARING DOME COMPOSITE

CROSS-REFERENCE TO RELATED APPLICATION

This application claims the benefit of U.S. Provisional Application No. 62/122,868 filed Nov. 1, 2014 and incorporates hereby by reference herein the aforementioned provisional application in its entirety.

FIELD OF THE INVENTION

The present invention relates to printed materials and more particularly to image bearing domed composites.

BACKGROUND OF THE INVENTION

Doming is used extensively by the printing industry to create product identifying labels, decals, etc. for a host of commercial products. Customarily the printed decal or label used the doming which relies upon a printed decal or label having an adhesive backing which is adhesively applied to a backing sheet followed by doming with a clear doming plastic material. Basically doming creates a raised domed surface typically overlaying or supporting a manufacturer or supplier logo, service, trademark, etc. Due to technological limitations such domed product use has been basically restricted to flat surface applications. Attempts to apply the flat surface domed products to curved surfaces leads to destruction or separation of the domed structure from the backing.

The traditional manufacture of domed decals, labels and the like typically involves applying an adhesive to the backside of a suitable printable substrate along with a strip away strip which prevents premature adhesion of the adhesive backing to unwanted substances. After imprinting (e.g. such as by silk screen printing) the front panel section of the substrate with a desired inscription, the imprinted substrate is domed with an uncured thermosetting doming precursor applied in a prescribed dosage onto the printed inscription under conditions and amounts sufficient to ultimately create a cured (i.e. thermoset) domed structure of the desired configuration overlaying the imprinted inscription. The thermosetting uncured resin application technique creates a viscous thermosetting mass possessing sufficient fluidity to flow about its application site while also possessing sufficient cohesiveness to form the desired contiguous domed structure which can be consistently reproduced with substantial unity in shape. Uncured thermosetting resins meeting these functional attributes are commonly available from manufactures and suppliers who specially formulate the uncured thermosetting precursors for use by doming manufacturers. The uncured domed resins overlaying the imprintation are typically cured often at an elevated oven temperature to set or cure the thermoset cross-linkage of the dome to the desired core thermoset polymeric structure. The curing of the thermoset polymeric dome provides a thermoset dome highly stable and resistant against mechanical, thermal and chemical deterioration which renders these labels ideally suited for the decaling of a host of consumer goods. The thermoset domes necessarily possess a high degree of clarity and transparency which allows an unobstructed view of the inscription protectively covered by the dome. The adhesive backing of the imprinted substrate backing may then be removed and applied to a label or decal supportive backing similarly equipped with a tear-away protective covering sheet which is removed for adhesive decaling or labeling by the manufacture of the labeled or decaled goods.

Unfortunately the decades old domed decals and labeling manufacture has heretofore been applicable only to those domed labels and decals which are necessarily applied to flat surfaced goods. Attempts to apply such domed thermoset polymeric labels and decals to curved surfaces inevitably results in inherent damage to the domed label or decal product. Thermoset polymeric fracturing, cracking, or separation from the curved surfaces unfortunately renders these domed labels and decals useless for such applications. A host of attempts to provide curved domes have led to the same inevitable destruction and failure of the domed decal or label. Attempts to apply stronger and more adhering adhesives to the domed decals and labels proved to be unsuccessful in preventing structural failure. Various other manufacturing techniques were also unsuccessful. A major problem with curved domes appears to be due to the memory properties of the thermoset polymer which overwhelms the domed substrate ability to retain the desired thermoset polymeric coating and domed structure when bent. Consequently the labeling and decaling of curved goods with domed labels or decals has remained an unsolved problem by the industry for decades.

There exists a host of factors which if not taken into account during the fabrication of the domed product can lead to dome product failure. Successful domed product manufacture necessitates that the dome provides chemical, weathering (e.g. moisture, etc.), solvent and physical (e.g. scratching, shattering, impact, abrasion, etc.) resistances normally encountered in its end usage. These desired physical and chemical attributes are typically provided by a cross-linked and transparent thermoset (e.g. polyurethane) domed plastic composite which typically protects a desired visually clear imprint (e.g. a trademark, logo, etc.) as customarily achieved in the manufacture of flat surface applied decals or labels. When applied to flat surfaces these domed products notoriously perform exceptionally. However, as pointed out attempts to apply these domed products to curved goods create stress fracturing and thermoset plastic separation from its backing components which inherently renders these domed product unsatisfactory for application to curved surfaces.

The doming problem is further compounded by the fact the doming manufacture necessitates a layering or tiering of multiple chemical components which must individually and collectively cooperatively function in a unitary manner so as to retain structural integrity when subjected to bending. This necessitates that not only the backing substrate but also each coating tier and dome must be cooperatively capable of being bent so that the composite structure, as a whole, uniformly bends and permanently retains its bent structural integrity without any bending failures. This must necessarily be accomplished with each element of the composite remaining firmly bonded together without any phase separation, fracturing, fissuring, or any other dome failure which would destroy the clarity and functional use of the dome. Any structural failures such as stress fracturing of the domed product becomes readily apparent by visual inspection.

In general there exist a number of manufacturers and suppliers of UV curable inks which may be adapted to a multiplicity of end uses. Certain of these inks are solvent based which includes those of a thermoplastic type. Due to the safety hazards associated with vaporized solvents, solvent based coatings have been increasingly phased out of production with the thermoset cured inks becoming more prominent.

Summary

It has been discovered that curved image bearing domed composites such as those used in domed decals and labels industry may be successfully manufactured in such a manner that the domed decals, labels, etc. will remain intact upon application to curved surfaces without any substantive change adversely affecting the original characteristics of the domed composite. The doming techniques used to prepare the printed domed substrates (e.g. decals, labels, etc.) pursuant to this invention uniquely and effectively overcome those problems which have heretofore prevented the past manufacture and use of decaling domes suitable for use on curved surfaces. The doming manufacture of this invention allows flat silk screening printing techniques to be used to prepare a flat image bearing domed composite (e.g. decal or label) which can be successfully bent to match the curvature of a manufactured good. This is accomplished via the appropriate use of specialized fabricating materials and processing conditions. It has been accordingly unexpectedly discovered that curved printed domed composites initially prepared upon a flat silk screening press may be subsequently bent and permanently applied to curved surfaces without any visible faults or tier separation of the composite. Since a large share of the consumer products have curved surfaces which heretofore could not be decaled or labeled with a curved domed label or decal, the present invention solves a problem which has perplexed the domed decal and labeling industry for years.

DETAILED DESCRIPTION OF THE INVENTION

Figure 1:
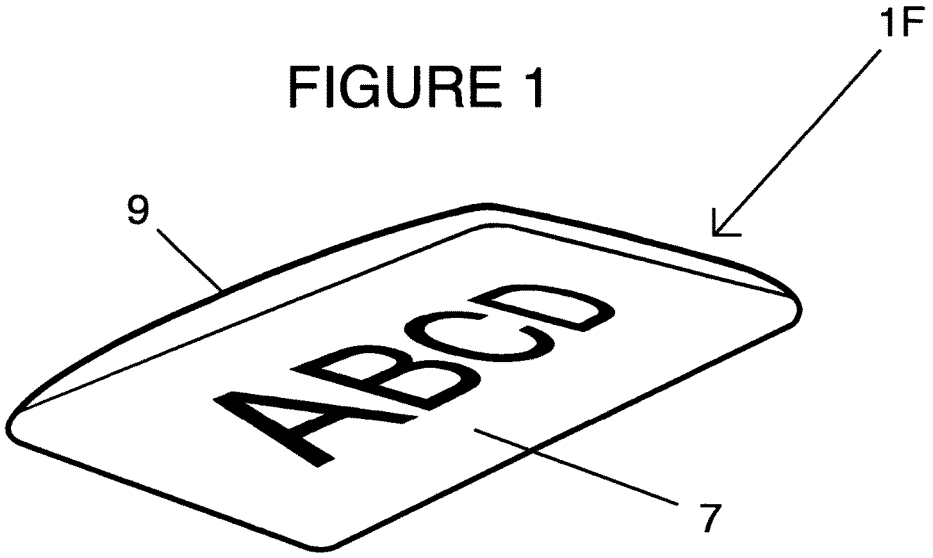
FIG. 1 is a bottom side view of a flat image bearing domed composite of this invention.
Figure 2:
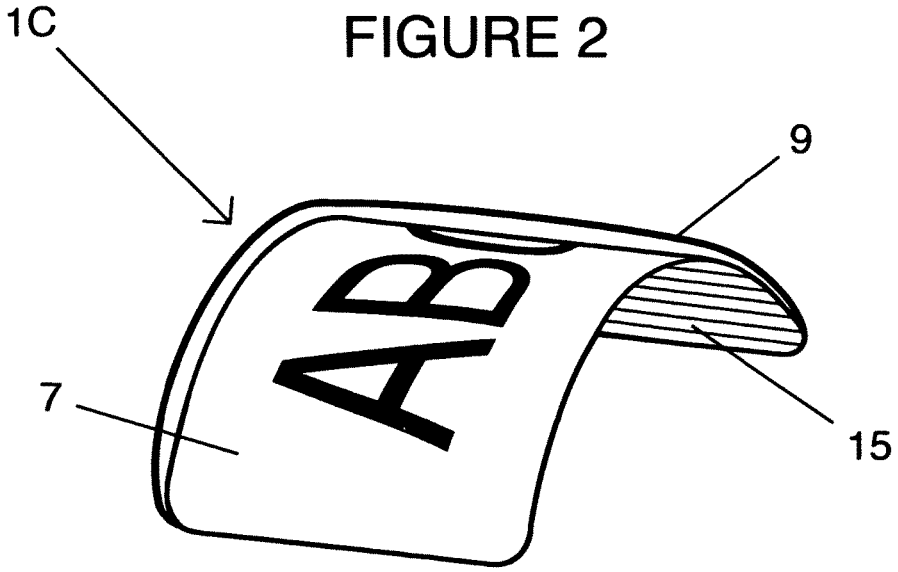
FIG. 2 is a side view of a curved image bearing domed composite prepared by bending the flat image bearing composite of FIG. 1 to a bent curvature mating onto a manufactured article for its intended use.
Figure 3:
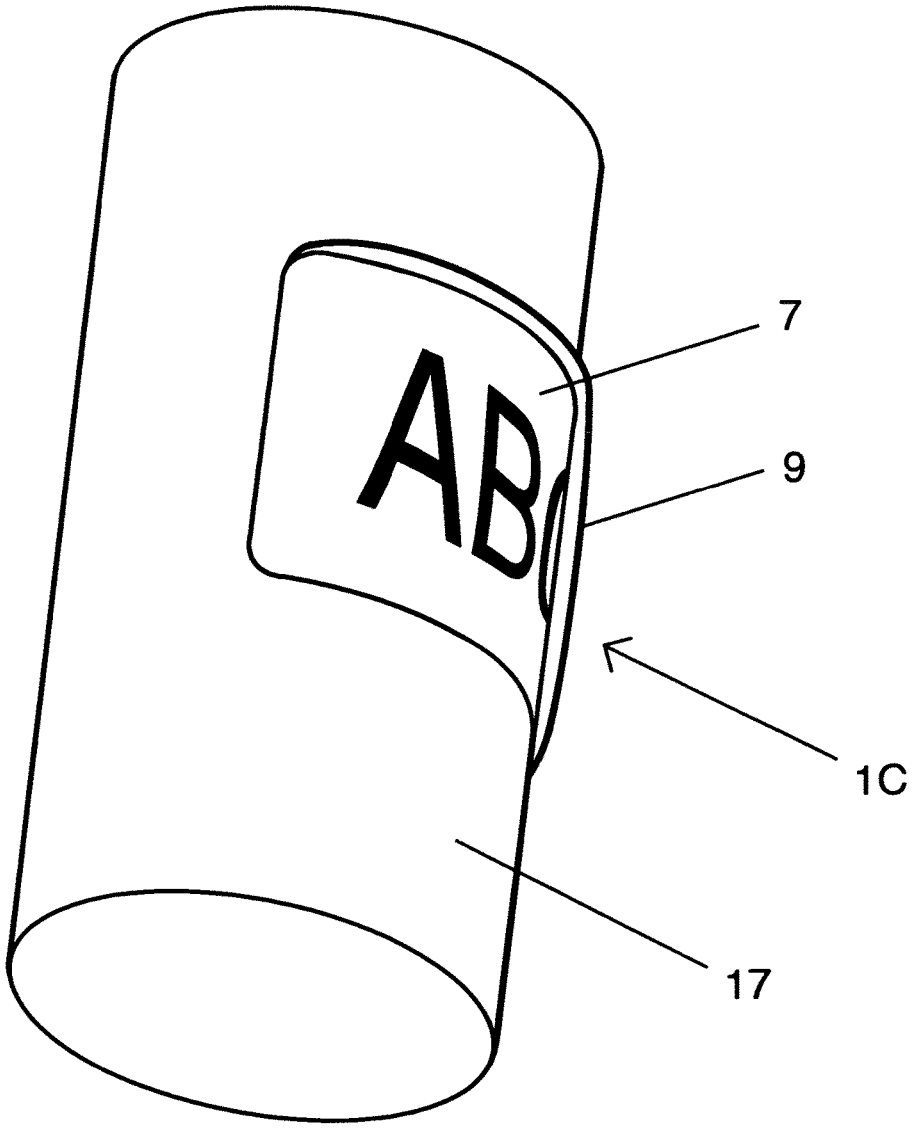
FIG. 3 depicts a partial top view of FIG. 2 showing the curved domed composite applied to the manufactured article of its intended use.
Figure 4:
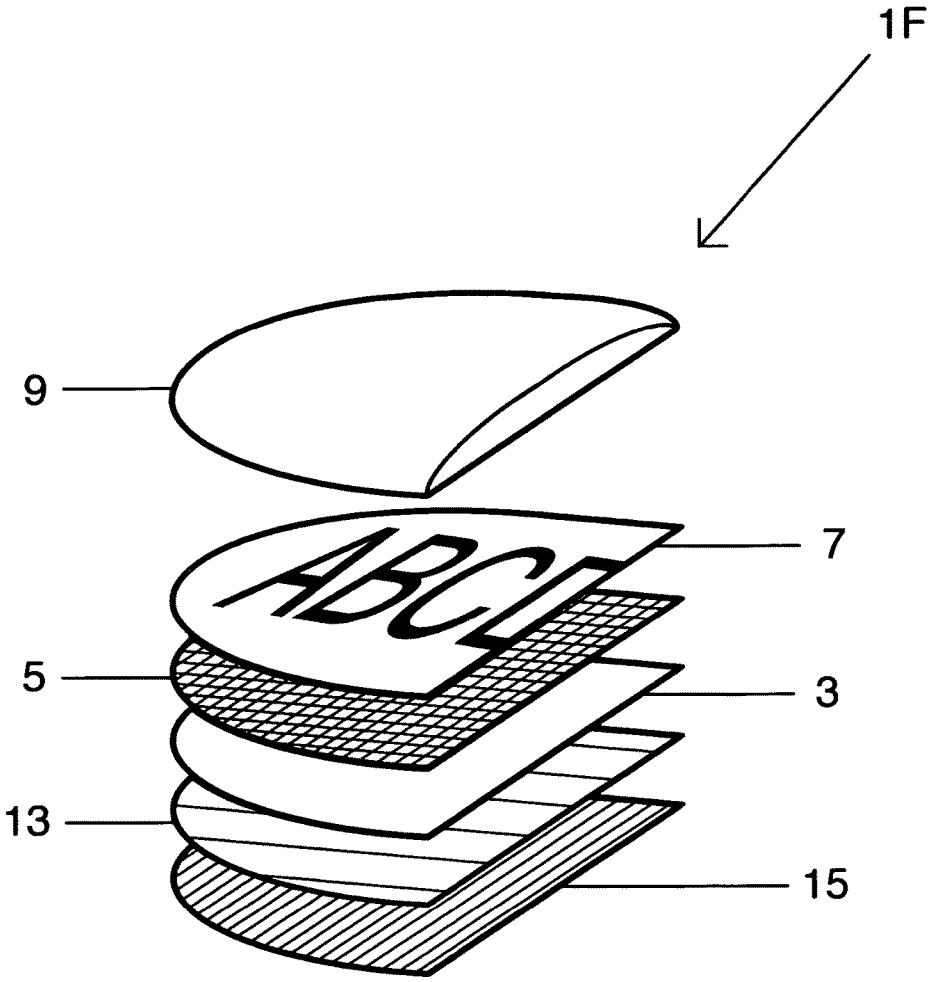
FIG. 4 illustratively depicts an exploded side view of the component parts of the image bearing domed composite of FIG. 1.
Figure 5:
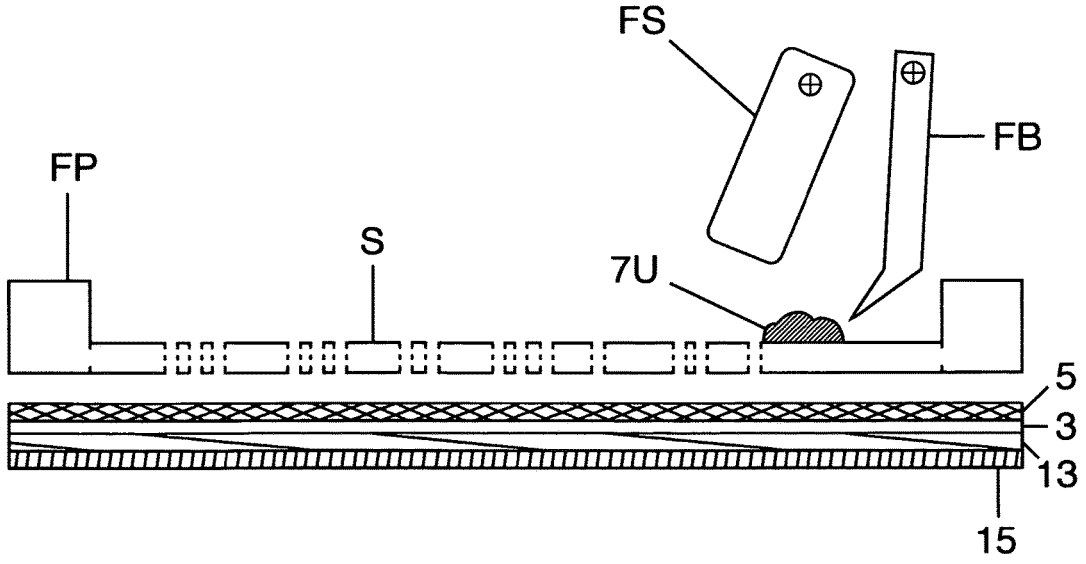
FIG. 5 is an illustrative cross-sectional representation depicting the commencement of the silk screen printing of a desired image upon a malleable metal sheet stock blank coated with a thermoset coating receptive to the silk screen printing thereof with a radiation-curable thermosetting silk screening ink.
Figure 6:
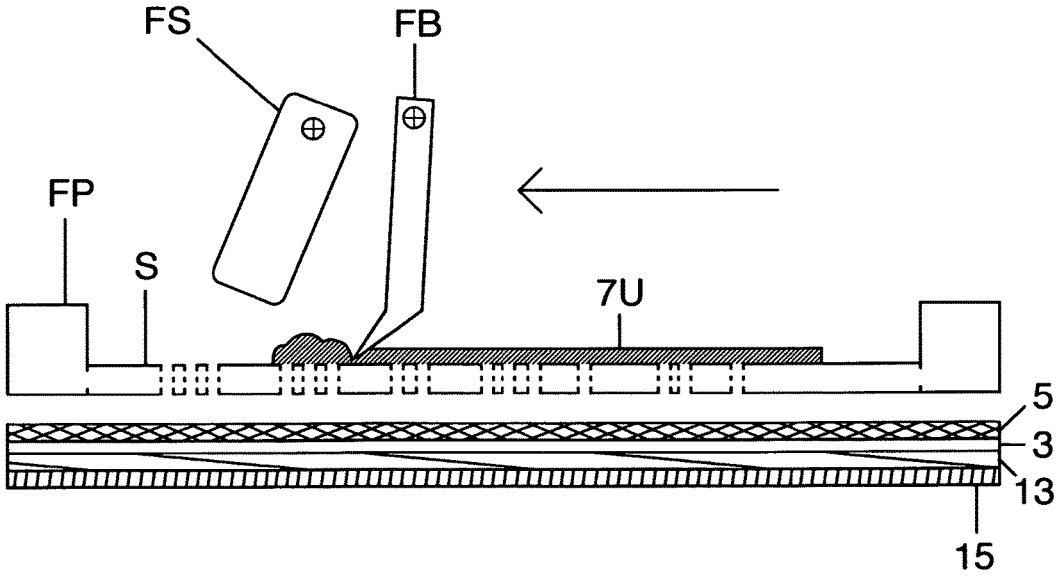
FIG. 6 depicts a sequential processing step in depositing the radiation curable thermosetting ink shown in FIG. 5 to a silk screening stencil.
Figure 7:
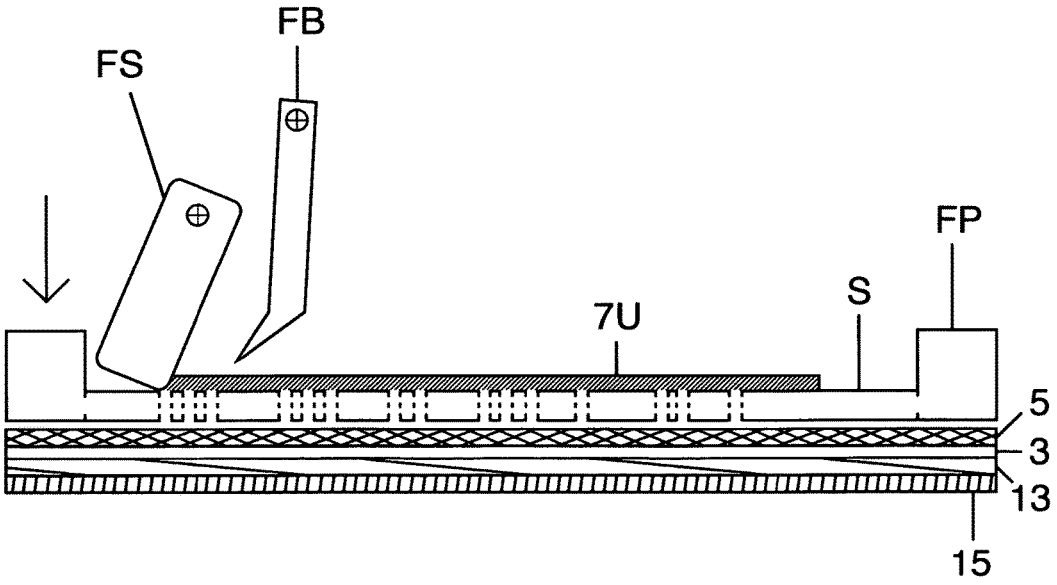
FIG. 7 is a cross-sectional representation of the silk screening printing process depicting the commencement of applying a radiation curable ink to the stencil.
Figure 8:
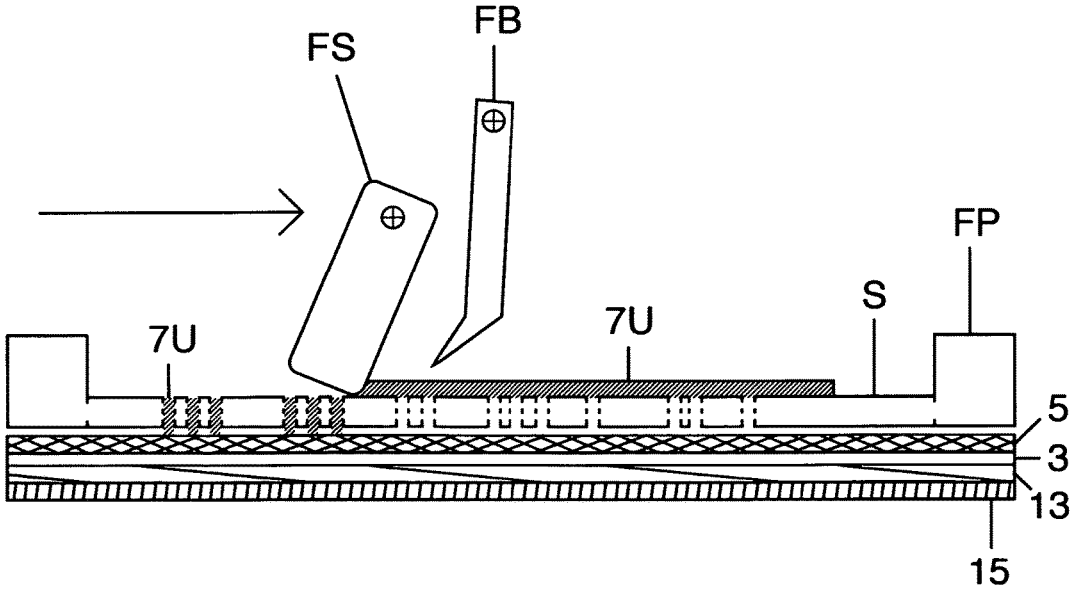
FIG. 8 depicts a subsequent sequential silk screening illustration of FIG. 7 depicting the silk screening process of initially applying the radiation curable printing ink coating to a substrate printable therewith.
Figure 9:
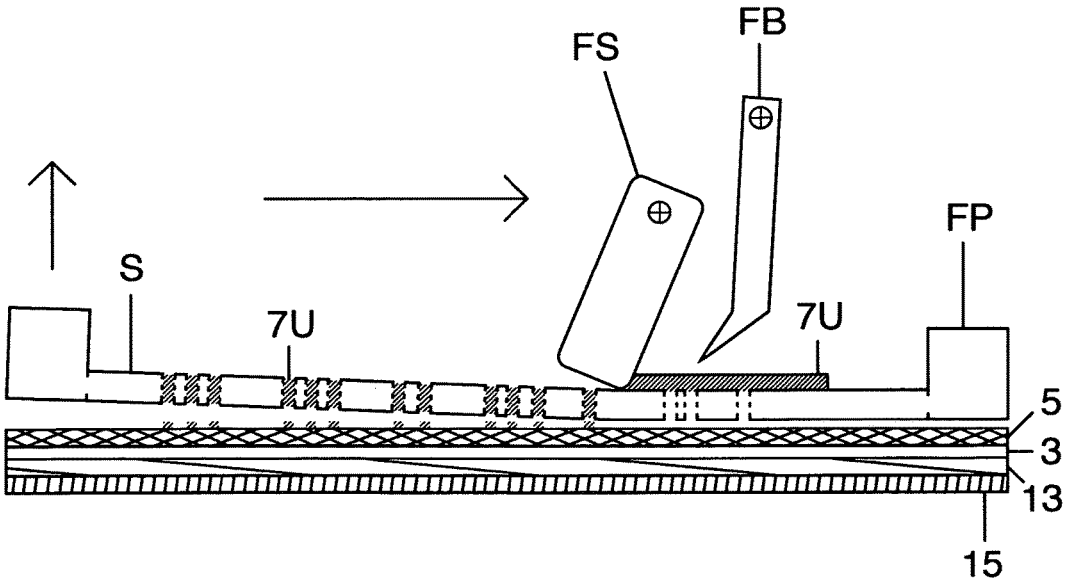
FIG. 9 is an illustration of a subsequent silk screen printing procedure to FIG. 8 showing the initial withdrawal of the stencil from the uncured printed substrate.
Figure 10:
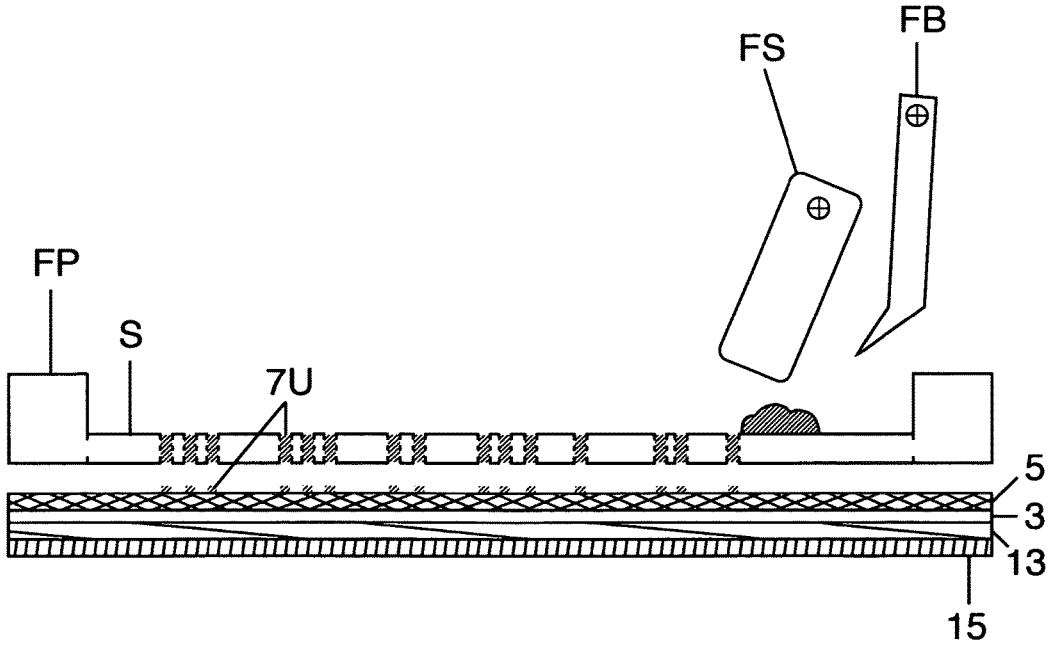
FIG. 10 is a sequential cross-sectional silk screening representation of FIG. 9 showing the removal of the stencil from the substrate coated with a radiation curable printing ink.

With reference to the Figures, the present invention provides an image bearing or imprinted domed composite (generally prefixed by 1) structured with multiple thermoset plastic tiered overlays cohesively integrated together so as to provide structural resistance against overlay separation and stress fracturing upon bending of the composite 1. In its manufacture the image bearing domed composite 1 may be provided in a flat FIG. 1 form 1F or as a curved or bent composite 1C as shown in FIG. 2. The tiered composite 1 is comprised of:

A. a ductile metallic sheet 3 of a thickness less than 50 mil coated with a thermoset plastic substrate coating 5 receptive to silk screen printing with a radiation curable ink;

B. a thermoset silk screened UV imagery coating 7 (i.e. the image bearing coating) integrally bounded to the thermoset substrate coating 5; and C. a capping thermoset plastic dome 9 integrally bounded to the thermoset imagery coating 7 to provide the domed composite 1;

with said domed composite 1 being resistant to tier separation and stress fracturing upon bending. Due to its tier separation and stress fracturing resistance, the flat domed image bearing thermoset composite 1F is bendable to a predetermined curvature so as to correspondingly mate onto a curved surface of a manufactured article 17, often referred to as a good. This feature as illustrated by FIG. 3 renders the arcuate surface of the curved domed image bearing thermoset composite 1C ideally suited for use as a domed decal or domed label for attachment to the curvature of manufactured consumer goods 17. The manufacturer of the consumer goods 17 may simply remove the adhesive protective strip 15 as shown in the FIGS. 1-2, 4 and 13-14 and adhesively apply the decal or label 1 to the manufactured good 17 as shown in FIG. 3.

It is essential for each coating tier (i.e. substrate 5 and imagery 7 coatings) and the dome 9 within the composite structure to have the capacity to tenaciously anchor onto each interfacing coating tier of the composite 1 so as to effectively prevent coating tier separation upon bending. Since domed decals and labels 1 necessitates a high degree of transparency for visualization of the imprinted imagery coating 7, each coating tier of the imagery ink coating 7 and the cured capping dome 9 must also possess sufficient shear fracturing resistance so as to maintain the desired visual clarity of the imagery ink coating 7 when the flat image bearing domed composite 1F is bent into the desired curved image bearing domed composite 1C. The capacity to bend without stress fracturing development necessitates that each coating tier (i.e. the substrate coating 5 and imagery ink coatings 7) as well as the thermoset plastic dome 9 collectively possess sufficient pliability so as to permit radial bending about the radial axis of the base metallic substrate 3. Excessive thermoset coating cross-linkage creates a rigid and brittle polymeric structure susceptible to stress fracturing and tiered coating separation. In addition each coating (i.e. 5 & 7) and the capping dome 9 must possess sufficient pliability to bend and maintain their bent structure without any overriding rebounding or memory forces tending to pull the coating 5 & 7 or dome 9 to its native unbent polymeric form. Moreover the entire thermoset imagery bearing domed composite 1 will necessarily include a compositional make up of tiered coatings (5 &7) and a dome 9 which collectively and uniformly possess corresponding cohesiveness, flexibility, resistance to interface separation, stress fracturing resistance and capacity to retain a stress bent configuration without any appreciable indigenous overriding polymeric memory factors to return to its indigenous flat polymeric form.

Figure 13:
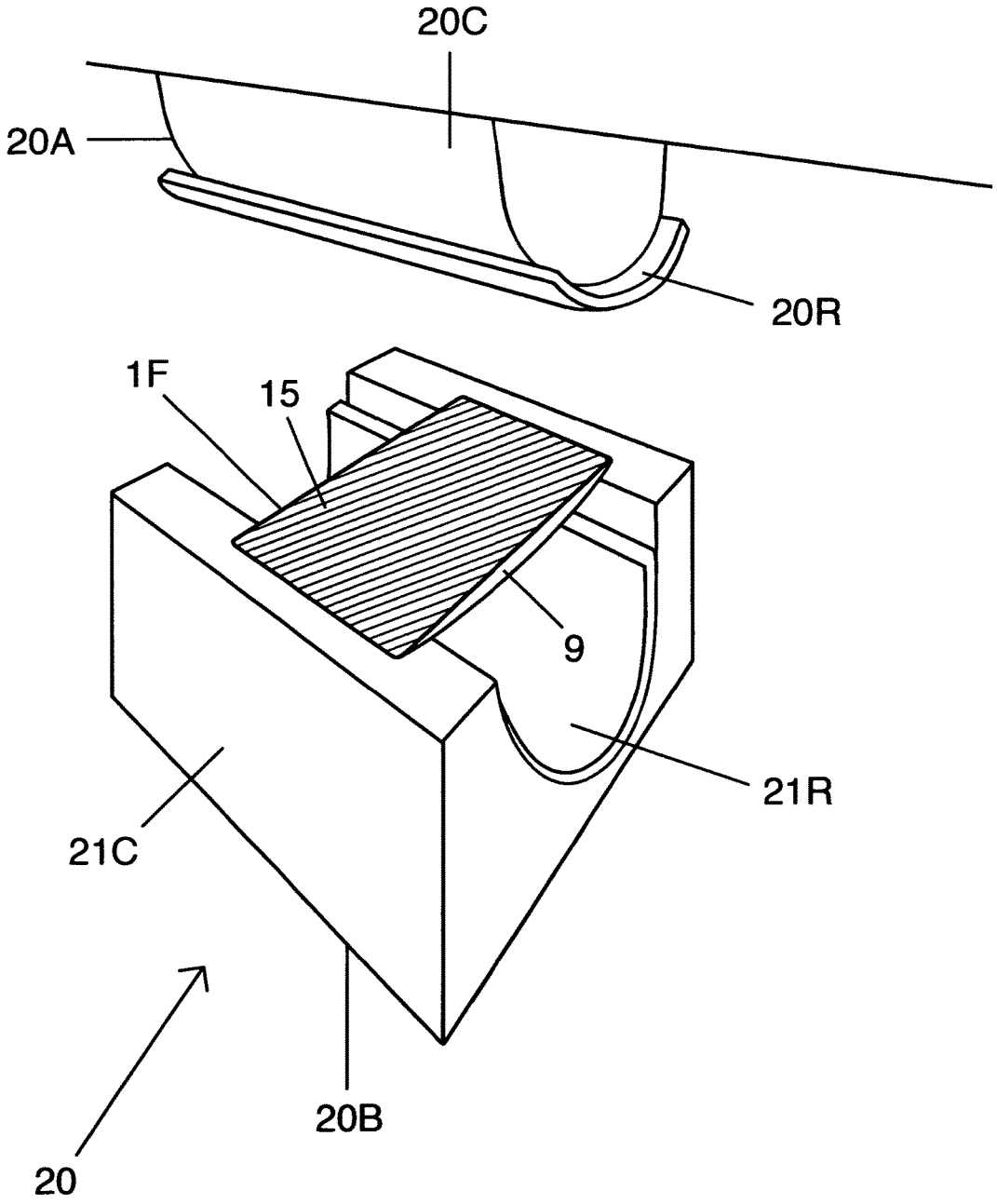
FIG. 13 is a perspective view of a forming device showing the flat image bearing composite of FIG. 1 in a position to commence bending thereof to a desired curvature.
Figure 14:
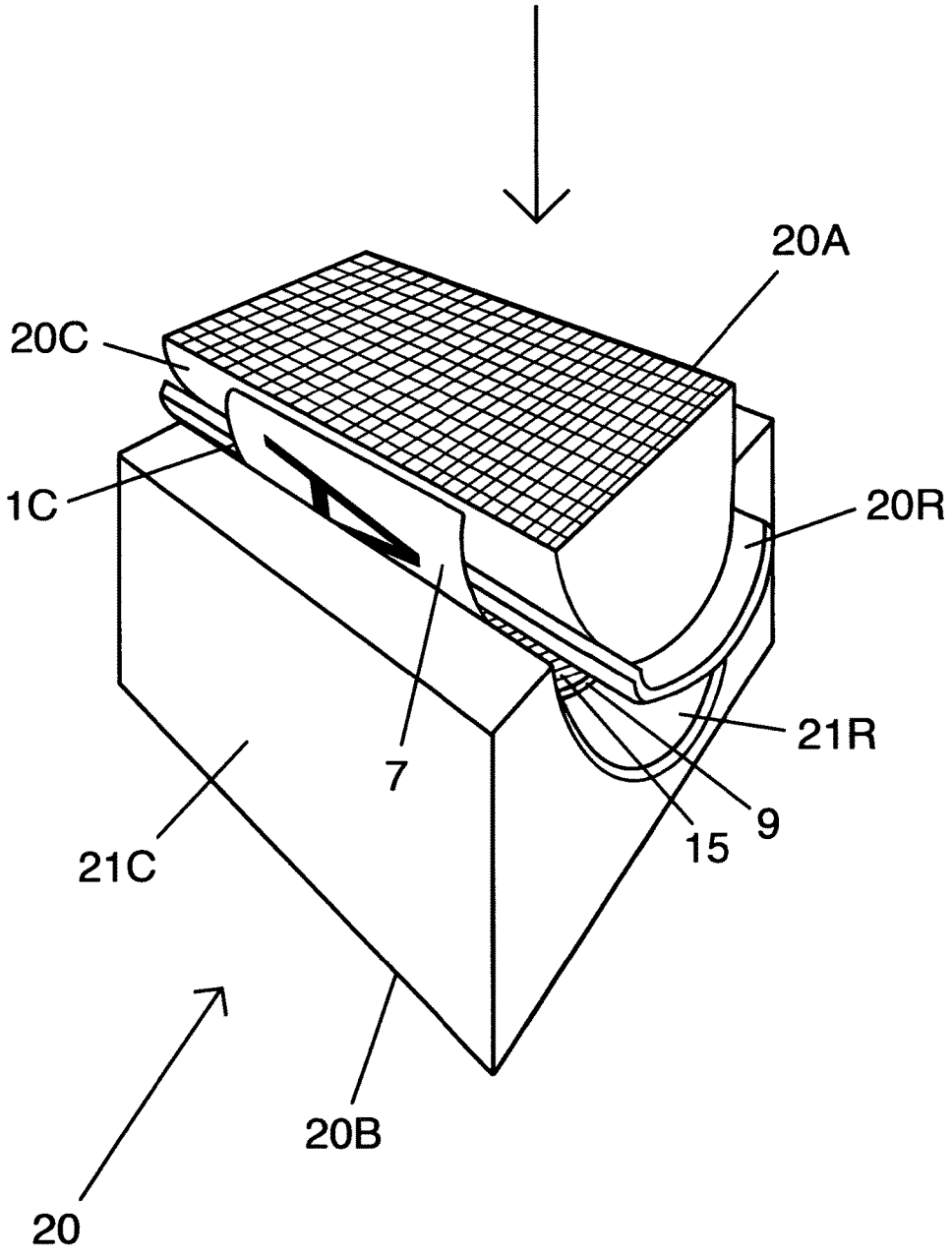
FIG. 14 is a perspective view depicting the forming device of FIG. 13 and the curved image bearing composite as illustrated by FIG. 2 being formed thereby.

The bending attributes are accordingly directly correlatable to the compositional make-up of the layered coating tiers (5 & 7) and the overcasted dome 9 of the composite 1. Although a broad range of plastic materials (e.g. thermoset and thermoplastics) possessing the tenacious anchoring, pliability adverse polymeric memory properties and resistance to stress fracturing upon bending are potentially applicable to the embodiments of this invention, the invention is particularly applicable to coating tiers generally classified as being compatible with silk screening inks of a radiation curable type. These radiation curable printing inks are typically applied as sequential layers of basic ink coatings which collectively provide the desired coloring effect to the cured coating imagery. The polymeric composition of the radiation curable silk screening inks and the radiation conditions of curing with a suitable light source are specifically adapted to create a composite 1 component possessing excellent pliancy and adhesive anchoring compatibility with the other interfacing component elements of the domed imagery bearing composite 1. The radiation curable silk screen printing inks also characteristically provide cured image bearing coatings 7 possessing excellent resistance to stress fracturing and interface coating separation when subjected to a bending of a flat domed imagery bearing composite 1F to a curved domed imagery composite 1C as illustrated by FIGS. 13-14. The radiation curable silk screening inks 7U are particularly adaptable to cured image bearing coatings 7 which are effectively cured by light emitting radiation sources and particularly those cured with low energy light sources such as the UV and LED curable inks.

The domed composite 1 of this invention provides a flat composite 1F structurally stabilized against fracturing or separation upon bending to a desired bent configuration. The domed composite 1 may be provided in the flat composite form 1F as illustrated by FIG. 1 with the ultimate consumer subsequently bending the stabilized composite 1F to the desired curvature of the curved composite 1C as illustrated by FIGS. 2 and 3. Irrespective of whether or not the imprinted composite 1 is provided to the ultimate consumer in a flat 1F or bent 1C composite structure, the domed imprinted composite 1 will advantageously include a double-faced adhesive backing 13 and a protective removable strip 15 end use. As shown in FIGS. 13-14, the protective strip 15 facilitates effective bending of the flat composite 1F. The composite 1 may advantageously be provided in a ready to apply consumer form which includes a curved composite 1C structure as illustrated by FIGS. 2 and 3 having a desired predetermined bend with a double-faced adhesive backing 13 equipped with a strip-away strip 15.

With particular reference to FIGS. 1-3 and 13-14, the unbent composite 1F containing the pliable, stress fracturing and tier separation resistance coatings (5 & 7) is suitable for bending to a desired curved composite form 1C (e.g. see FIG. 2) for application onto a curved article of manufacture 17 as illustrated by FIGS. 2-3 is disclosed. As illustrated by the exploded FIG. 4 view, the flat composite 1F is capped by a thermoset dome 9 firmly bonded to a thermoset imagery coating 7 tier (which may consist of several basic coloring thermoset coatings integrally bonded together) which in turn is securely bonded to a thermoset radiation imagery receptive coating 5 which in turn is firmly bonded to the ductile base metal substrate 3.

In the manufacture of the curved composite 1C, it is advantageous to apply a ready-to-use double faced adhesive backing 13 to substrate 3. The double faced adhesive strip 13 adhesively engages onto the substrate 3 and allows adhesive application of the backing to an article of manufacture or good 17 as illustrated by FIG. 3. A tear-away strip 15 (e.g. plastic or cellulosic) covering strip prevents unwanted premature adhesive use of the composite 1 and as shown in FIGS. 13 and 14 facilitates the composite bending.

Pursuant to the present invention there is further provided a method for the manufacture of image bearing domed composites 1 and curved composites 1C suitably adapted for placement upon curved surfaces of manufactured goods 17. The method of composite manufacture comprises:

a. providing a printable coated substrate comprised of a malleable metal sheeted substrate 3 of less than a 50 mil sheet thickness with the substrate 3 having a wax-free cross-linked thermoset plastic coating 5 receptive to silk screening printing with a UV activated thermosetting ink;
b. silk screen printing the surface of the thermoset plastic coating 5 with a thermosetting UV curable silk screening printing ink formulated with a UV photoinitiator,
c. applying sufficient UV radiation thereto so as to allow the printable ink 7U to cure to a thermoset image bearing coating 7;
d. applying an uncured thermosetting doming composition 9U to the thermoset image bearing coating 7 at a sufficient viscosity and coherency so as to provide an uncured dome 9U of a desired doming configuration; and
e. thermosetting the uncured dome 9U to provide the image bearing dome composite 1 under curing conditions sufficient to provide a cured thermoset dome 9 capping the thermoset image bearing coating 7 with said dome 9 being structurally integrated and bonded onto the thermoset image bearing coating 7 and possessing sufficient flexibility so as to impart resistance against tier separation of the cured thermoset dome 9 from the image bearing coating 7 and stress fracturing when said domed composite 1 is subjected to a subsequent bending about an arcuate angle.

The flat thermoset image bearing domed composite 1F having the appropriate flexibility and integrated structure may thereafter be bent to a desired curvature so as to mate onto the curvature of a desired good 17 to which the curved domed composite 1C is intended to be applied. The curved domed composites 1C as provided by this invention possess excellent clarity and transparency without evidencing any tier separation or stress fracturing.

In general the manufacture of the curved image bearing domed composite 1C includes the use of ductile substrates 3 and particularly sheeted ductile metallic substrates 3 having sufficient ductility so as to permit bending thereof to a desired curvature. This generally applies to ductile and malleable milled sheets typically of a sufficient size and thickness to serve as a backing substrate 3 for the curved image bearing composites 1C of this invention. The surfaces of the substrates 3 are appropriately cleansed of any foreign matter which would interfere with the thermoset coating thereof. The ductile metal substrates 3 will necessarily include a thermoset plastic substrate coating 5 receptive to a radiation curable printing ink 7U which typically lends itself to silk screen printing upon a flat press FP with a UV curable silk screen printing ink 7U. The ductile substrates 3 as applied herein will generally have a milled sheet thickness of less than 50 mils, typically ranging from about 10 mil to about 40 mils and most typically useful are those ranging from about 15 to about 30 mils in thickness.

The backside of the printable coated substrate 3 may appropriately include an adhesive backing 13 protectively shielded with a plastic film or strip covering 15 which may be subsequently uncovered allowing direct application of the curved image bearing composite 1C to the curved surface of the consumers decaled product. Alternatively the adhesive backing 13 may be applied after the manufacture of the curved image bearing domed composite 1C or at the point of end use. The double-faced adhesive backing 13 allows one adhesive side to be adhesively applied to the metal substrate 3 while the other adhesive side being available for attachment to the consumer good 17. Although the composite 1 will most suitably include an adhesive backing 13 for securing the curved composite 1 to an article of manufacture 17, other means of attachment (e.g. spot welding, glues, rivets, etc.) may also be used to secure the curved composite 1 to an article of manufacture 17. The unbent composite 1F may be bent to a convex or concave configuration which bending will most suitably bear a substantially constant radial bend. Abrupt angular bends are more susceptible to stress fracturing than those of a substantially uniform degree of angular bending.

Although the base substrate 3 possess bending characteristics, the substrate 3 will typically evince a greater resistance to unbending forces than the thermoset plastic coating and dome overlays (i.e. 5, 7 & 9) of the cured composite 1. In general suitable base substrates 3 include ductile milled metallic sheets 3 such as sheeted aluminum, copper, iron, nickel, manganese, tin, alloys thereof and the like. Particularly well-suited as a substrate 3 are the milled aluminum sheets and especially the substantially pure aluminum alloy milled sheets 3 free from wax and other foreign matter. The metallic sheeted substrates 3 are appropriately coated with a thermoset substrate coating 5 receptive to a thermoset silk screening ink 7U which coating 5 characteristically retains its coated structural integrity when subjected to bending forces. The substrate thermoset coating 5 and the radiation (e.g. UV) cured thermoset imagery coating 7 must also collectively possess tenacious bonding properties so as to contribute structural unity in the composite structure 1 upon bending.

A coated aluminum 1100 alloy characterized as having a "mill finish" of wax free clear/wax free clear aluminum milled sheet roll of a 0.012-0.032 inch thickness, temper H-14, finish mil, product code 557MX supplied by Lawrence and Frederick, Inc. 411 East North Avenue, Streamwood Ill., 60107 provides a suitable radiation curable or UV printable substrate which may be used herein. This particular aluminum 1100 alloy was further characterized as having a minimum tensile strength of 20.0 ksi. The topside of the aluminum 1100 alloy sheet 3 was coated with a clear coat of a wax free cross-linked thermoset polyester coating 5 of a 0.3-0.65 mil dry film thickness. The polyester coating 5 is further characterized as being receptive to UV silk screening and having a pencil hardness of F-2H Eagle turquoise lead, T-bend IT and a cure of 50+MEK double rubs. The backside of the 1100 aluminum alloy sheeting blanks were provided with a conventional decal adhesive 13 having a strippable protective strip 15 to prevent premature adhesion to foreign substances. The peelable protective strip 15 accordingly served to protect against unwanted and premature adhesion of the domed decal 1 during the subsequent processing thereof and its subsequent handling until used by the consumer.

Although FIGS. 5-10 generalize the silk screening printing process, the actual process may be suitably conducted upon a large format UV flatbed inkjet printer (JFX500-2131 manufactured and sold by Mimaki, USA, Inc.) equipped with RASTER Link 6 software which controls and monitors the UV silk screening ink coloring and application to the coated aluminum substrate 3 (as further disclosed in my provisional application). The direction of ink application was transverse (but not necessary) to the curvature of the bend as subsequently imparted to the curved domed product 1C.

Numerous different polyfunctional and crosslinkable monomers and oligomers may be used to provide the UV curable coatings as illustrated U.S. Pat. No. 5,395,863 to K. G. Burns et al. and the references cited herein. A particular suitable UV silk screening ink includes an ink manufactured and distributed under the product name BLENDING WHITE, product code CoMetal—W501G295 by Sun Chemical Corporation, 631 Central Ave. Carlstadt N.J. 07072. The material safety data sheet for BLENDING WHITE indicates the UV curing ink is formulated with a N-Vinylpyrrolidone which apparently serves as a curing reactant. The BLENDING WHITE UV curing ink contains a UV photoinitiator to facilitate the UV curing. The UV curing was initiated by mercury vapor lamp deep heat irradiation. Another illustrative applicable UV curing silk screen ink includes a high speed UV curing ink (LUS-150) sold by Mimaki formulated with a fast UV curing photoinitiator.

In composite type structures and especially those of a multi-tiered type, thermoset coating shrinkage can create problems for both the cationic and free-radical variety of UV inks. The manner in which curing is initiated and the post curing conditions can effectively help to alleviate the shrinkage problem. Exhibits A-1 and A-2 of my provisional application disclosed a suitable silk screening printer equipped with the operative software, and a logic board which effectively monitors and control the application of the UV initiated thermoset inks to the silk screening printer as applied to the coated base substrate 3. The aforementioned UV cured thermoset imaginary coating 7 provides an excellent thermoset coating possessing a desired degree of cross-linkage, hardness, cohesion and ductility to collectively provide composite 1 which may be bent without experiencing any visual coating fracturing, separation or imagery damage upon the bending of the composite 1.

With reference to the illustrative sequential silk screening processing steps of FIGS. 5-10, the silk screening procedure may be effectuated by an ink blocking woven mesh stencil S for receiving the desired silk screened image. As sequentially illustrated by FIGS. 5-7, an ink applicating flood bar FB and full squeegee FS may then be moved across the stencil S to force the pumped uncured silk screening ink 7U onto the UV silk screening receptive coating 5 of the aluminum sheet substrate 3. Typically a single ink color may be sequentially applied with each pass as an uncured silk screening ink coating 7U with multiple silk screening passes customarily being used to develop the desired finished uncured imagery coating 7. Similarly, a single color not requiring multiple passes may use a single pass to provide the desired uncured coating imprintation 7U. However, most decals exhibiting a trademark or other image bearing mark will typically require multiple silk screen passes of uncured coatings 7U to create the desired decal.

With further reference to FIGS. 5-10 the silk screening ink application may be effectuated with a flat press FP (a partial view of which is depicted) supported by a flexible support to provide a highly effective means for applying the UV curable ink 7U to the UV ink receptive substrate coating 5 which then upon UV curing provides the desired vivid thermoset coating imagery 7 possessing exceptional flex adherence and stabilization against imagery coating separation or shrinkage from the substrate thermoset coating 5 and the capping dome 9. The cured imagery coating 7 exhibits excellent stress fracturing resistance even when subjected to subsequent bending forces which would normally lead to coating fracturing or separation of the thermoset tiered coatings and cured dome 9.

The cured silk screened thermoset imagery coatings 7 provided herein may also be applied to other radiation curable inks 7U such as the thermoset imagery prepared by light activated or induced LED silk screen printing system. The LED cured silk screened printing will generally necessitate a LED photoinitiator (e.g. commercially available from Sun Chemical Corp.) as a component to the silk screening ink (e.g. BLENDING WHITE). Curing accelerators such as identified by product code ST-370/G265 90020 (manufactured and sold by Sun Chemical Corporation) which identifies 2-hydroxy-2-methy-1-propanone as a hazardous ingredient have been found particularly effective to effectuate the LED ink curing. An exemplary LED curable silk screening ink useful in preparing the composites 1 of this invention would include a blend of 97% by weight the aforementioned BLENDING WHITE and 3% by weight of a LED cure accelerator. Except for the use of the LED radiation source instead of a UV light source, the over-all curing procedures for a LED silk screening procedure are substantially the same as a UV procedure used in the UV imagery coating 7.

The curing of the uncured imagery coating 7U as applied to the substrate coating 5 is then subjected to irradiation with light emitting source for a period of time under conditions sufficient to provide the desired thermoset imagery coating 7 firmly bonded and anchored to the thermoset substrate coating 5 as is each successive tier of cured thermoset ink coating 7 applied thereto. The bonding of the thermoset imagery bearing coating 7 to the substrate coating 5 and any tiered image bearing coatings 7 overlays thereto creates a desirable cross-linked interfacial bond which possesses a sufficient cross-linked structure to create a firm bonding therebetween while also providing a degree of crystallinity sufficiently low enough to provide flexibility and permit effective bending of the substrate 3, substrate thermosetting coating 5, the imagery bearing thermoset coating 7 and the thermoset dome 9. This unique accomplishment may be effectuated by using the appropriate level of thermosetting coating reactants thermoset under light emitting radiating conditions which provide the desired tiered coatings possessing sufficient flexibility to be bent without adversely affecting the integrated bonding of the cured image bearing domed composite 1C.

Figure 11:
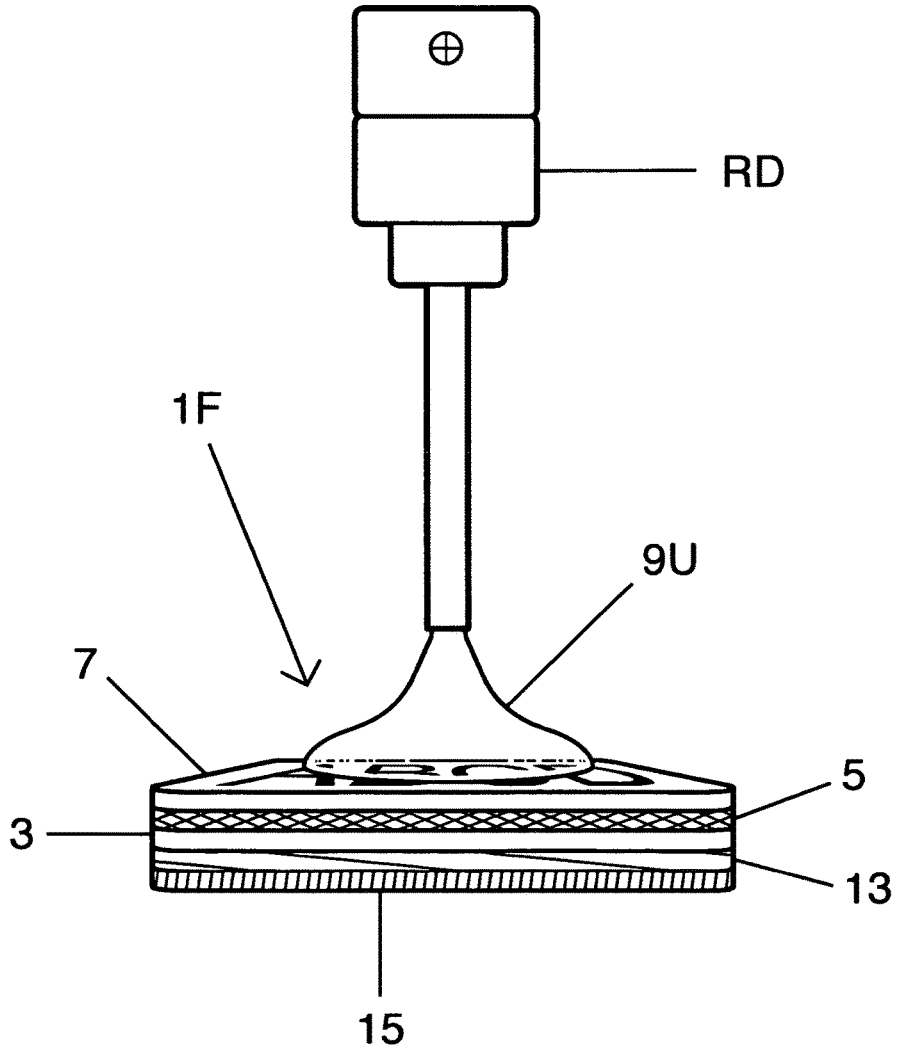
FIG. 11 is a side view depiction of a doming applicator applying an uncured thermosetting doming resin to a substrate coated with a cured thermoset printing ink imagery.
Figure 12:
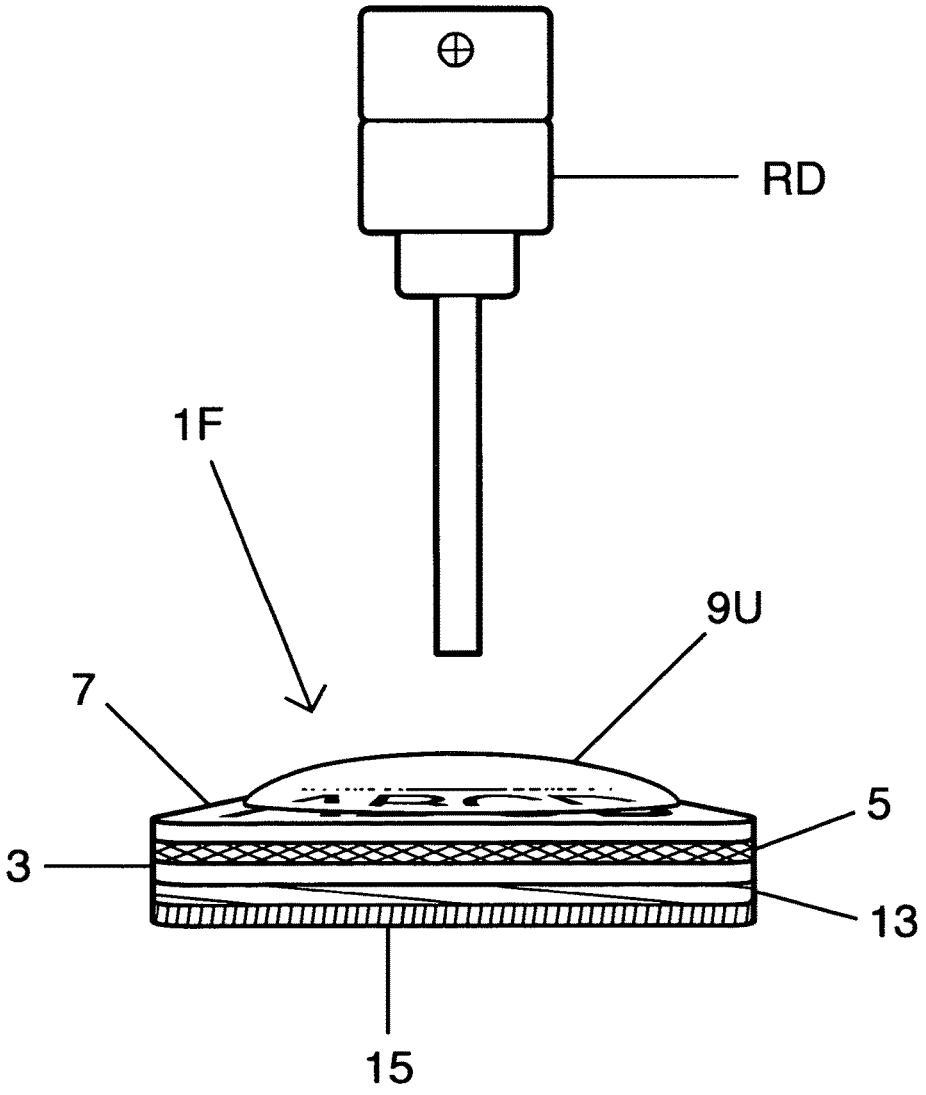
FIG. 12 is a side view depiction of FIG. 11 showing the thermoset doming resin cohesively spreading to form the desired doming for the domed imagery bearing composite illustrated by FIGS. 1-3.

After the silk screened print has been applied and irradiated, the cured image bearing substrate is ready for a doming process as illustratively depicted by FIGS. 11 and 12. The doming procedure is generally commenced by a series of synchronized doming resin dispensers RD of which only one is illustratively depicted by FIGS. 11 and 12. The doming resin dispenser RD is typically applied in a manner to create individual domed pieces as depicted by FIG. 12. Each of the substrates 3 bearing the thermoset imagery coating 7 bonded to substrate coating 5 separately receives a dosage dispensed by resin dispenser RD with uncured doming reactant 9U. The most commonly used thermoset polymer for domed labels and decals constitutes a doming thermosetting polyurethane formulated and supplied by manufacturing sources specializing in thermosetting doming resins. Typically the uncured polyurethane resins are provided as a two part curable resin system (e.g. resin and hardner) which are blended together at the dome manufacturing site. The two part resin system 9U is designed to provide the appropriate viscosity and flow cohesiveness which when properly dispensed spreads and forms a desired dome structure for curing as depicted by FIGS. 11-12. Conventional doming processes using an uncured polyurethane resin formulation dispensed at an appropriate dosage and viscosity having a proper curing formulation will repetitively produce substantially uniform dome 9. The curing typically commences upon blending the two part system 9U (e.g. resin and hardener) together at the plant site followed by elevated temperatures to accelerate the curing rate. The overall curing system is designed to create a transparent crosslinked thermoset domed polymeric structure having the appropriate hardness and crystallinity so as to permit bending of the image bearing domed composite 1 to a desired curvature for its intended end use. To accomplish this objective, the metal substrate 3 the cured substrate coating 5 and the cured imagery coating 7 must necessarily possess bending attributes commensurate with the cured dome 9 so that the entire composite 1F will substantially bend in unison. Should one or more of the composite elements fail to possess the essential prerequisites stress fracturing and tiered separation within composite will occur.

A typical two package system as supplied to the dome maker will illustratively include potentially cross-linkable reagents such as polypropylenglycol, pyperidyl pentamethyl sebacate, benzotriazolyl-terz-butyl hydroxyl phenyl propionyloxy-polyoxyethylene and a catalytic amount of diphenyl (tetrapropenyl succinate-O) mercury. When the aforementioned cross-linkable hardeners are blended together with a prescribed amount of isophorone di-isocyanate 3-isocyanatomethyl-3, 5, 5-trimethylcyclohexylisocyanate and polyether isophorone diisocyanate prepolymer, the combined thermosetting reactants commence to cure (thermoset) until the desired degree of cross-linkage and thermosetting of the thermoset occurs to create the desired thermoset polymeric dome.

The viscosity and cohesiveness of the uncured thermosetting blend of hardeners and resin are customarily tailored so as to create the desired degree of doming in the finished dome product 1 as illustrated by FIGS. 11-12. As is well recognized, the type and amounts of catalyst, the particular mix and blend of the reactants (e.g. polyols and isocyanates), curing temperatures etc. will typically have a direct effect upon application viscosities, cohesiveness of the dome formation, curing time, and ultimate properties of the cured dome 9. Since the cured thermoset polymer has an inherent propensity to return to its linear or original thermoset form (e.g. its memory properties), the present invention provides a thermoset polymeric dome 9 and composite 1 which when used in conjunction with the other thermoset composite components (i.e. coating tiers) will retain its desired curvilinear form. Consequently, the curved thermoset image bearing domed composite 1C provides a unique curved decal or label suitable for application onto curved surfaced goods 17. Similar to the other thermoset coatings of the composite 1, the crystallinity characteristics of the cured domed product 9 will have a bearing upon the flex characteristics of the domed product 1 since excessive cross-linkage tends to create an excessively higher degree of hardness and product crystallinity which will substantially lessen its ductility. By maintaining the extent of cross-linkage and crystallinity sufficiently low enough to provide the desired bending characteristics herein, the desired objectives of stabilized curved dome composite 1C herein may be effectively achieved. This will typically arise at a pencil hardness (ASTM 3363) of less than 5 H and most typically less than about 3 H. Once applied (e.g. adhesively) to a curved surface of a labeled or decaled good 17, the curved domed composite 1C label or decal as provided by this invention will permanently retain its desired preformed curvature without any visible stress fractures or separation amongst the cured thermoset dome components.

Before applying the uncured polyurethane resin 9U, the sheeted coated aluminum 1100 alloy 3 may be kiss-cut (e.g. stamping, scoring, etc.) to a predetermined configuration for the desired domed product configuration followed by stripping of the waste aluminum therefrom. Procedurally this permits the uncured polyurethane resin 9U to flow uniformly across the entire surface area of the imagery coating 7. The blend of the doming thermosetting polyurethane resin 9U may be applied upon the cured silk screened image bearing substrate 3 (as depicted by FIG. 12) by a resin dispenser RD in an amount sufficient to spread evenly in a substantially uniform manner to provide a domed layer of the desired thickness and configuration. The uncured polyurethane dome 9U may then be suitably subjected to oven curing followed by rack curing for an additional period of time (e.g. 24 hours) sufficient to create the desired cured dome 9.

Excessive pencil hardness arising in the aluminum alloy coating 5, the UV curved thermosetting ink coating 5 or the thermoset polymeric doming material 9 in the finished product 1 may yield a discordant thermoset composite structure possessing insufficient flexibility and more prone to thermoset polymeric separation and fracturing. Thus, the formulation and curing conditions for each of the thermoset tiers are specifically patterned to yield a composite 1 of cohesive thermoset coating 5 having a sufficiently pliable, amorphous and ductile structure to permit the composite structure of the tiered thermoset coatings and dome 9 to be effectively bent about a desired forming mandrel 20. Excessive cross-linkage which leads to a more crystalline, less pliable and a rigid cross-linked structure is more prone to suffer stress fractures and loss of interfacial adhesiveness between tiers and film separation when subjected the domed product 1 is subjected to bending about a curved surface. Accordingly the thermosetting reagents, the curing catalyst and curing rates and the conditions used to produce each of the tiered thermoset coatings (5 & 7) and dome 9 composites must necessarily be formulated and cured in a manner which collectively provide a thermoset composite stable against separation and fracturing. Objectively the finished domed product 1 will typically possess sufficient bending characteristics to allow a 180 degrees bending of the flat domed inscribed composite 1F about a 2 inch diameter steel pipe without any visible evidence of fracturing, or cracking of the thermoset composite or visible tier separation of the composite 1.

After the domed polyurethane resin 9U has cured sufficiently the flat thermoset composite 1F containing the cured dome 9 is ready to be bent to a desired arcuate or curvature mating onto the particular goods 17 to which the image bearing curved domed composite 1C (e.g. decal) is to be applied. As depicted by FIGS. 13-14, this may be effectively accomplished by any bending means which creates the desired mating curvature of the goods 17 to which the curved imagery bearing composite 1C (e.g. decal) is to be applied. Surprisingly the arcuate shaped composite 1C decals provided by this invention permanently retain their shape and accordingly may be shipped in a finished curved form to the ultimate end user. The ultimate user needs only to remove the adhesive protecting strip 15 from the adhesive decal backing 13 and directly apply the curved composite decal 1C to the decaled product curved surface 17.

FIGS. 13 and 14 depict a composite bending device generally prefixed by 20 with subunits thereof bearing a 20 and 21 numbering. The depicted forming device 20 includes a male forming unit or die (generally designated as 20A) and a female forming unit or die generally designated as 20B. The male forming unit 20A and the female forming unit 20B are designed to impart the desired curvature to the flat composite 1F depicted by FIG. 1 to provide the desired finished curved composite 1C as further illustrated by FIGS. 2-3 and 14. The forming male unit 20A includes a solid forming core 20C and the female unit 20B also includes a solid female forming core 21C both of which may be constructed of any solid material (e.g. metal, wood, plastic, hard rubber) bearing the appropriate mating configuration to create upon press forming the desired curvature in the curved composite 1C. The forming device 20 will most appropriately be conducted under conditions which uniformly apply the bending forces to the unbent cured image bearing domed composite 1F to create the desired or predetermined bent composite 1C structure. By equipping the forming dies 20A & 20B with pliable interfacial contacting surfaces (20R & 21R) while bending the flat composite 1F, stress fracturing and tier separations are effectively alleviated. As may be observed from FIGS. 13 and 14, the male forming interface 20R is equipped with pliable rubber and a pliable female rubber forming interface 21R are correspondingly positionally placed as to be in direct interfacial contact with the flat thermoset imagery bearing composite 1F during the bending procedure. As may be observed from FIGS. 13 and 14, the flat composite 1F is compressed and curved between the forming dies 20A and 20B. The pliable interfacial contacting surfaces 20R, 21R create a forming environment in which the stress forces placed upon the forming composite 1 are thereby uniformly distributed and absorbed about the forming dies 20A and 20B by the shock absorbing or arresting members 20R & 21R. This uniform distribution of localized stress factors upon the deforming composite 1 substantially reduces the creation of localized stress fracturing within the finished curved composite 1C.

Any pliable die interface 20R and/or 21R which provides a finished arcuate composite 1C substantially free from internal stress fracturing and tiered separation of the thermoset components may be effectively used for this purpose.

By equipping both of the forming dies 20A & 20B with shock absorbing units 20R & 21R, a more uniform dissipation of the stress inducing forces is accomplished. Exemplary pliable materials which may be used for this purpose include synthetic and natural rubber, cork, pliable natural synthetic fibrous materials, etc. The hard rubber shock arrestors 20R & 21R (synthetic or natural) are particularly suitable shock absorbing materials for use in the bending procedure herein. The horizontally outwardly extending rods shown in FIGS. 13 and 14 are adapted to allow for securing forming die extensions to forming dies 20A & 20B to accommodate larger sized decals and labels.

The integrated composite 1 structure as provided by this invention exhibits exceptional resistance to cracking or phase separation (i.e. coating, substrate and dome separation) even when bent about a radial of a substantial arc (e.g. a ¾ inch OD steel pipe). As provided by the bend tolerable curved thermoset composites 1 of this invention, domed composites 1 having at least a 4 mm arcuate bend about a chord measuring 5 cm may be easily effectuated. The invention is not limited to curved composites of a constant radii, but will accommodate convex and concave curvatures characterized as having rather sharp abrupt angular changes. The unexpectedly superior composite character of the domed composites 1 creates these unique bending attributes.

It is rather surprising that the curved polyurethane domed composite 1C does not create dome separation from the imagery coating 7 or develop stress fractures as habitually occurs with prior attempts to provide such curved domed decals or labels. Since the uncured polyurethane blend is cured into a non-linear and cross-linked form, it would normally be anticipated that any subsequent bending thereof would result in its attempt to return to its memorized indigenous form. However, the overall processing conditions and materials of the domed product construction as supplied to the current invention suppresses the indigenous memory characteristics of the thermoset polyurethane domed structure. Also each of the overcast thermoset coatings 5 & 7 contribute corresponding ductile and integrated adherence conjointly so that the entire composite 1 bends as a unitary composite product without registering any adverse memory attributes. This phenomenon allows the flat cured polyurethane domes 9 of the flat imagery bearing composite 1F to be subsequently bent to a desired curvature without any visible interfacing component interfacial separation or stress fracturing. Consequently curved thermoset imagery bearing domed composites 1C exhibiting the desired optical clarity of the flat imagery bearing domed composite 1F are now feasible.

What is claimed is:

1. A method of providing an image bearing domed thermoset composite capable of being bent to a curvilinear configuration to mate onto a curved surfaced consumer good, said method comprising:

a. providing a bendable substrate having a greater resistance to unbending than an overcasted thermoset polymeric dome applied thereto, with said substrate having a thermoset substrate coating receptive to a silk screen printing of a desired image thereupon, b. coating the thermoset substrate coating with a UV curable thermosetting imagery coating by silk screen printing of the desired image upon the thermoset substrate coating using a flat surfaced silk screening printer, wherein the UV curable thermosetting imagery coating comprises a UV curable silk screening ink formulated thermosetting reactants and a UV photoinitiator, c. irradiating the UV curable thermosetting imagery coating with UV radiation to provide a cured thermoset imagery coating bonded to the substrate coating, d. applying an uncured thermosetting doming resin blend upon the cured thermoset imagery coating at an application viscosity and amount sufficient to create the overcasted thermoset polymeric dome for the image bearing domed thermoset composite, e. curing the uncured thermosetting doming resin blend under curing conditions sufficient to cure and bond the resin blend to the thermoset imagery coating and provide the thermoset polymeric dome of the image bearing domed thermoset composite, and f. bending the image bearing domed thermoset composite to a predetermined curvilinear configuration adapted to mate onto the curved surfaced consumer good directly after "to cure and bond the resin blend to the thermoset imagery coating and provide the thermoset polymeric dome of the image bearing domed thermoset composite.

2. The method according to claim 1 wherein the bending includes the bending of the image bearing domed thermoset composite between a bending device having mating male and female bending units equipped with interfacing shock absorbing members between which the image bearing domed thermoset composite of the predetermined curvilinear configuration is formed.

3. The method according to claim 2 wherein the image bearing domed thermoset composite of the predetermined curvilinear configuration is applied to a mating surface of the curved surfaced a consumer good.

4. The method according to claim 3 wherein the substrate includes a milled aluminum sheet of a thickness ranging from about 10 to about 25 mils.

5. The method according to claim 4 wherein the thermoset substrate coating comprises a thermoset polyester coating and the uncured thermosetting doming resin blend comprises a thermosetting polyurethane.

6. The method according to claim 3 wherein the thermoset substrate coating includes N-Vinylpyrrolidone as a thermosetting reactant.

7. The method according to claim 1 wherein the bendable substrate comprises a milled aluminum sheet of less than a 50 mil thickness.

8. The method according to claim 1 wherein the UV curable imagery coating comprises a thermosetting LED silk screening coating formulation formulated with an LED photoinitiator and a LED curing accelerator and the thermosetting silk screening coating formulation is cured via a LED radiation source to provide an LED cured thermoset imagery coating.

9. The method according to claim 1 wherein the uncured thermosetting doming resin blend consists essentially of a polyurethane thermosetting doming resin blend.

10. The method according to claim 1 wherein the image bearing domed composite is a decal bearing a trademark imagery.

* * * * *